US008750747B2

(12) United States Patent
Yagata et al.

(10) Patent No.: US 8,750,747 B2
(45) Date of Patent: Jun. 10, 2014

(54) DEVELOPER COLLECTING DEVICE AND IMAGE FORMING APPARATUS

(75) Inventors: Kazuyuki Yagata, Kanagawa (JP); Masaaki Tokunaga, Kanagawa (JP); Kiyotoshi Kaneyama, Kanagawa (JP); Masatoshi Yamada, Kanagawa (JP); Katsunori Kikuchihara, Kanagawa (JP); Yoshihiro Enomoto, Kanagawa (JP); Hiroyuki Koide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 531 days.

(21) Appl. No.: 13/088,041

(22) Filed: Apr. 15, 2011

(65) Prior Publication Data

US 2012/0114367 A1 May 10, 2012

(30) Foreign Application Priority Data

Nov. 8, 2010 (JP) ..... 2010-250091

(51) Int. Cl.
*G03G 15/16* (2006.01)

(52) U.S. Cl.
USPC ..... 399/101; 399/99; 399/102; 399/103; 399/149

(58) Field of Classification Search
USPC ..... 399/99, 101, 102, 103, 149
See application file for complete search history.

(56) References Cited

U.S. PATENT DOCUMENTS

2007/0230989 A1* 10/2007 Maeda et al. ..... 399/92

FOREIGN PATENT DOCUMENTS

JP 2007-171822 A 7/2007

* cited by examiner

*Primary Examiner* — David Gray
*Assistant Examiner* — Michael Harrison
(74) *Attorney, Agent, or Firm* — Sughrue Mion, PLLC

(57) ABSTRACT

A developer collecting device includes a housing provided with an opening opposed to a developer carrying member, a collecting member provided along an edge of the opening at a downstream end of the opening in a transporting direction in which the developer carrying member transports the developer, a sealing member provided along an edge of the opening at an upstream end of the opening in the transporting direction, a suction path that extends along a longitudinal direction of the housing and that is connected to a suction unit for sucking the developer into the housing, a developer transporting unit that is provided between the opening and the suction path and that transports the developer collected in the housing, a filter member disposed between the developer transporting unit and the suction path, and a hood member disposed between the opening and the filter member and separated from the filter member.

10 Claims, 9 Drawing Sheets

DEVELOPER COLLECTING DEVICE AND IMAGE FORMING APPARATUS

CROSS-REFERENCE TO RELATED APPLICATIONS

This application is based on and claims priority under 35 USC 119 from Japanese Patent Application No. 2010-250091 filed Nov. 8, 2010.

BACKGROUND

The present invention relates to a developer collecting device and an image forming apparatus.

SUMMARY

According to an aspect of the invention, there is provided a developer collecting device including a housing provided with an opening opposed to a developer carrying member that carries and transports developer, the opening being long in a direction orthogonal to a transporting direction in which the developer carrying member transports the developer; a collecting member provided along an edge of the opening at a downstream end of the opening in the transporting direction, the collecting member being capable of coming into contact with and separating from the developer carrying member, the collecting member removing the developer from an outer peripheral surface of the developer carrying member and collecting the developer into the housing when the collecting member is in contact with the outer peripheral surface of the developer carrying member; a sealing member provided along an edge of the opening at an upstream end of the opening in the transporting direction, the sealing member being capable of coming into contact with and separating from the developer carrying member, the sealing member sealing a gap between the developer carrying member and the housing when the sealing member is in contact with the outer peripheral surface of the developer carrying member; a suction path that extends along a longitudinal direction of the housing, the suction path being connected to a suction unit for sucking the developer removed from the developer carrying member into the housing; a developer transporting unit provided between the opening and the suction path, the developer transporting unit transporting the developer collected in the housing to an end of the housing in the longitudinal direction of the housing; a filter member that is long in the longitudinal direction of the housing, the filter member being disposed between the developer transporting unit and the suction path; and a hood member that is long in the longitudinal direction of the housing, the hood member being disposed between the opening and the filter member and separated from the filter member.

BRIEF DESCRIPTION OF THE DRAWINGS

An exemplary embodiment of the present invention will be described in detail based on the following figures, wherein.

DETAILED DESCRIPTION

Figure 1:
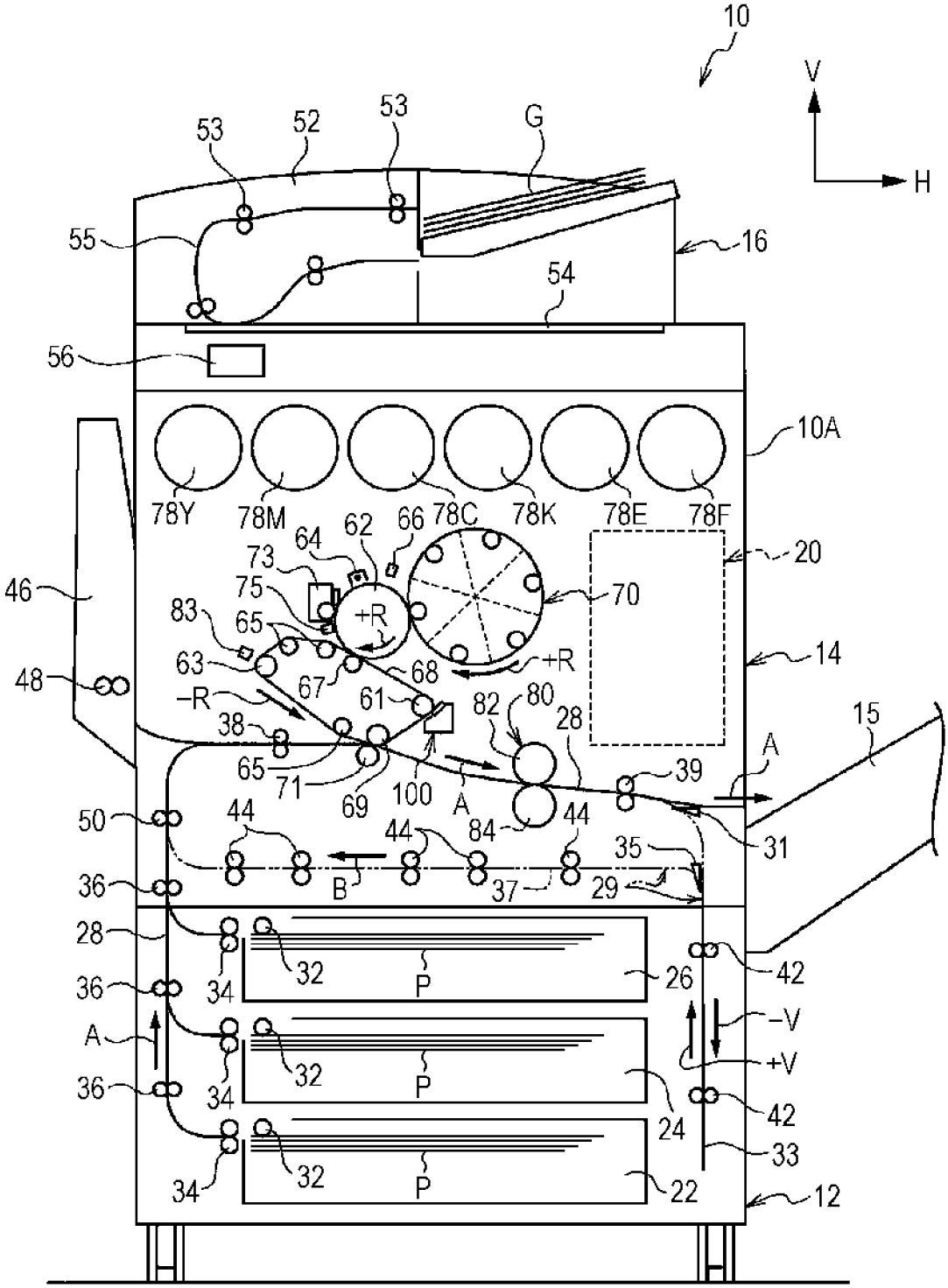
FIG. 1 illustrates the overall structure of an image forming apparatus according to an exemplary embodiment.

An exemplary embodiment of the present invention will be described in detail with reference to the drawings. In FIG. 1, the direction shown by arrow V is defined as an upward direction (vertical direction) with respect to an image forming apparatus 10, and the direction shown by arrow H is defined as a rightward direction (horizontal direction) with respect to the image forming apparatus 10. In addition, the side visible in FIG. 1 is defined as the front side of the image forming apparatus 10. In the present exemplary embodiment, recording paper P is used as an example of recording medium. In the following description, upstream and downstream sides in a transporting direction of the recording paper P are sometimes referred to simply as "upstream side" and "downstream side", respectively.

Referring to FIG. 1, the image forming apparatus 10 includes, in order from bottom to top in the vertical direction, a sheet storing unit 12 in which the recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10.

The sheet storing unit 12 includes a first storage unit 22, a second storage unit 24, and a third storage unit 26 in which sheets of recording paper P having different sizes are stored. Each of the first storage unit 22, the second storage unit 24, and the third storage unit 26 are provided with a supplying roller 32 that supplies the stored sheets of recording paper P to a transport path 28 in the image forming apparatus 10. Pairs of transporting rollers 34 and 36 that transport the sheets of recording paper P one at a time are provided along the transport path 28 in an area on the downstream of each supplying roller 32.

In addition, a pair of transporting rollers 50 are provided downstream of the transporting rollers 36 near the third storage unit 26. The transporting rollers 50 are arranged to guide the sheets of recording paper P that have been transported from a reverse transport path 29, which will be described below, into the transport path 28. A pair of positioning rollers 38 are provided downstream of the transporting rollers 50. The positioning rollers 38 temporarily stops each sheet of recording paper P and feeds the sheet toward a second transfer position, which will be described below, at a predetermined timing.

In the front view of the image forming apparatus 10, a part of the transport path 28 that is upstream of the transporting rollers 50 extends vertically along a straight line. A downstream part of the transport path 28 including the positioning rollers 38 extends from the left side to the right side of the image forming unit 14. More specifically, the downstream part of the transport path 28 extends along a substantially straight line to a paper output unit 15 provided on the right side of an apparatus body 10A. The reverse transport path 29, which is provided for reversing and transporting the sheet of recording paper P, is located below the downstream part of the transport path 28 including the positioning rollers 38.

The reverse transport path 29 includes a first guiding member 31 that guides the sheets of recording paper P from the transport path 28 to the reverse transport path 29; a reversing unit 33 which extends vertically along a straight line from the lower right area of the image forming unit 14 to the lower right area of the sheet storing unit 12; a second guiding member 35 that guides the sheets of recording paper P that have been transported by the reversing unit 33 from the reversing unit 33 to a transporting unit 37, which will be described below; and the transporting unit 37 that transports the sheet of recording paper P guided by the second guiding member 35.

A downstream part of transporting unit 37 joins the transport path 28 in the area between the transporting rollers 36 near the third storage unit 26 and the transporting rollers 50. The reversing unit 33 is provided with plural pairs of transporting rollers 42 that are arranged with predetermined intervals therebetween, and the transporting unit 37 is provided with plural pairs of transporting rollers 44 that are arranged with predetermined intervals therebetween.

The first guiding member 31 has a substantially rectangular shape in front view, and a point end of the first guiding member 31 is moved by a driving unit (not shown) to one of the transport path 28 and the reverse transport path 29. Thus, each sheet of recording paper P is guided along one of the transport path 28 and the reverse transport path 29. Similarly, the second guiding member 35 has a substantially rectangular shape in front view, and a point end of the second guiding member 35 is moved by a driving unit (not shown) to one of the reversing unit 33 and the transporting unit 37. Thus, each sheet of recording paper P is guided along one of the reversing unit 33 and the transporting unit 37.

A foldable manual sheet-feeding unit 46 is provided on the left side of the apparatus body 10A. When a sheet of recording paper P is supplied from the manual sheet-feeding unit 46, the sheet is transported by transporting rollers 48 and is inserted into the transport path 28 at a position downstream of the transporting rollers 50 and upstream of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transporting rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving rightward.

The image forming unit 14 includes a cylindrical photoconductor 62, which is an example of a latent-image carrying member. The photoconductor 62 is arranged in a substantially central area of the apparatus body 10A such that an axial direction thereof extends in the front-back direction of the apparatus body 10A. The photoconductor 62 is rotated in the direction shown by arrow +R (clockwise in FIG. 1) by a driving unit (not shown), and carries an electrostatic latent image formed by irradiation with light. In addition, a corotron charging member 64 that charges the outer peripheral surface of the photoconductor 62 is provided above the photoconductor 62 so as to face the outer peripheral surface of the photoconductor 62.

An exposure device 66 is provided so as to face the outer peripheral surface of the photoconductor 62 at a position downstream of the charging member 64 in the rotational direction of the photoconductor 62. The exposure device 66 includes a light emitting diode (LED). The outer peripheral surface of the photoconductor 62 that has been charged by the charging member 64 is irradiated with light (exposed to light) by the exposure device 66 on the basis of an image signal corresponding to each color of toner. Thus, an electrostatic latent image is formed.

The exposure device 66 is not limited to those including the LED. For example, the exposure device 66 may be structured such that the outer peripheral surface of the photoconductor 62 is scanned with a laser beam by using a polygon mirror. A rotation-switching developing device 70, which is an example of a developing unit, is provided downstream of a position where the photoconductor 62 is irradiated with light by the exposure device 66 in the rotational direction of the photoconductor 62. The developing device 70 visualizes the electrostatic latent image on the outer peripheral surface of the photoconductor 62 by developing the electrostatic latent image with toner of each color. The developing device 70 will be described in detail below.

An intermediate transfer unit 60 (see FIG. 2) is provided downstream of the developing device 70 in the rotational direction of the photoconductor 62 and below the photoconductor 62. A toner image (developer image) formed on the outer peripheral surface of the photoconductor 62 is transferred onto the intermediate transfer unit 60 in a first transfer process. The intermediate transfer unit 60 includes an endless intermediate transfer belt (intermediate transfer body) 68, which is an example of a developer carrying member. The intermediate transfer belt 68 rotates in the direction shown by arrow −R (counterclockwise in FIG. 1).

The intermediate transfer belt 68 is wound around a driving roller 61 that is rotated by the controller 20, a tension-applying roller 63 that applies a tension to the intermediate transfer belt 68, plural transporting rollers 65 that are in contact with the inner peripheral surface (back surface) of the intermediate transfer belt 68 and are rotationally driven, and an auxiliary roller 69 that is in contact with the inner peripheral surface of the intermediate transfer belt 68 at the second transfer position, which will be described below, and is rotationally driven.

A first transfer roller 67 is opposed to the photoconductor 62 with the intermediate transfer belt 68 interposed therebetween. The first transfer roller 67 transfers the toner image formed on the outer peripheral surface of the photoconductor 62 onto the outer peripheral surface (front surface) of the intermediate transfer belt 68.

The first transfer roller 67 is in contact with the inner peripheral surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the outer peripheral surface of the intermediate transfer belt 68.

A second transfer roller 71, which is an example of a transfer unit, is opposed to the auxiliary roller 69 with the intermediate transfer belt 68 interposed therebetween. The second transfer roller 71 performs a second transfer process in which toner images that have been transferred onto the outer peripheral surface of the intermediate transfer belt 68 in the first transfer process are transferred onto the sheet of recording paper P. The position between the second transfer roller 71 and the auxiliary roller 69 serves as the second transfer position at which the toner images are transferred onto the sheet of recording paper P. The second transfer roller 71 is provided with a retracting mechanism (not shown) that allows the second transfer roller 71 to move toward and away from (come into contact with and separate from) the outer peripheral surface of the intermediate transfer belt 68.

The second transfer roller 71 is separated from the outer peripheral surface of the intermediate transfer belt 68 until the toner images of respective colors are all transferred onto the outer peripheral surface of the intermediate transfer belt 68 in the first transfer process. After the toner images of the respective colors are all transferred onto the outer peripheral surface of the intermediate transfer belt 68, the second transfer roller 71 comes into contact with the outer peripheral surface of the intermediate transfer belt 68. Then, the second transfer roller 71 receives electricity from a power source (not shown), so that a potential dereference is generated between the second transfer roller 71 and the auxiliary roller 69, which is grounded. Thus, the second transfer process is carried out in which the toner images on the outer peripheral surface of the intermediate transfer belt 68 are transferred onto the sheet of recording paper P.

A cleaning device 100, which is an example of a developer collecting device, is opposed to the driving roller 61 with the intermediate transfer belt 68 interposed therebetween. The cleaning device 100 collects residual toner T (see FIGS. 9A and 9B) that remains on the outer peripheral surface of the intermediate transfer belt 68 after the second transfer process. The cleaning device 100 will be described in detail below.

A position detection sensor 83 is opposed to the tension-applying roller 63 at a position outside the intermediate transfer belt 68. The position detection sensor 83 detects a predetermined reference position on the outer peripheral surface of the intermediate transfer belt 68 by detecting a mark (not shown) on the outer peripheral surface of the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the outer peripheral surface of the photoconductor 62 instead of being transferred onto the outer peripheral surface of the intermediate transfer belt 68 in the first transfer process.

Figure 2:
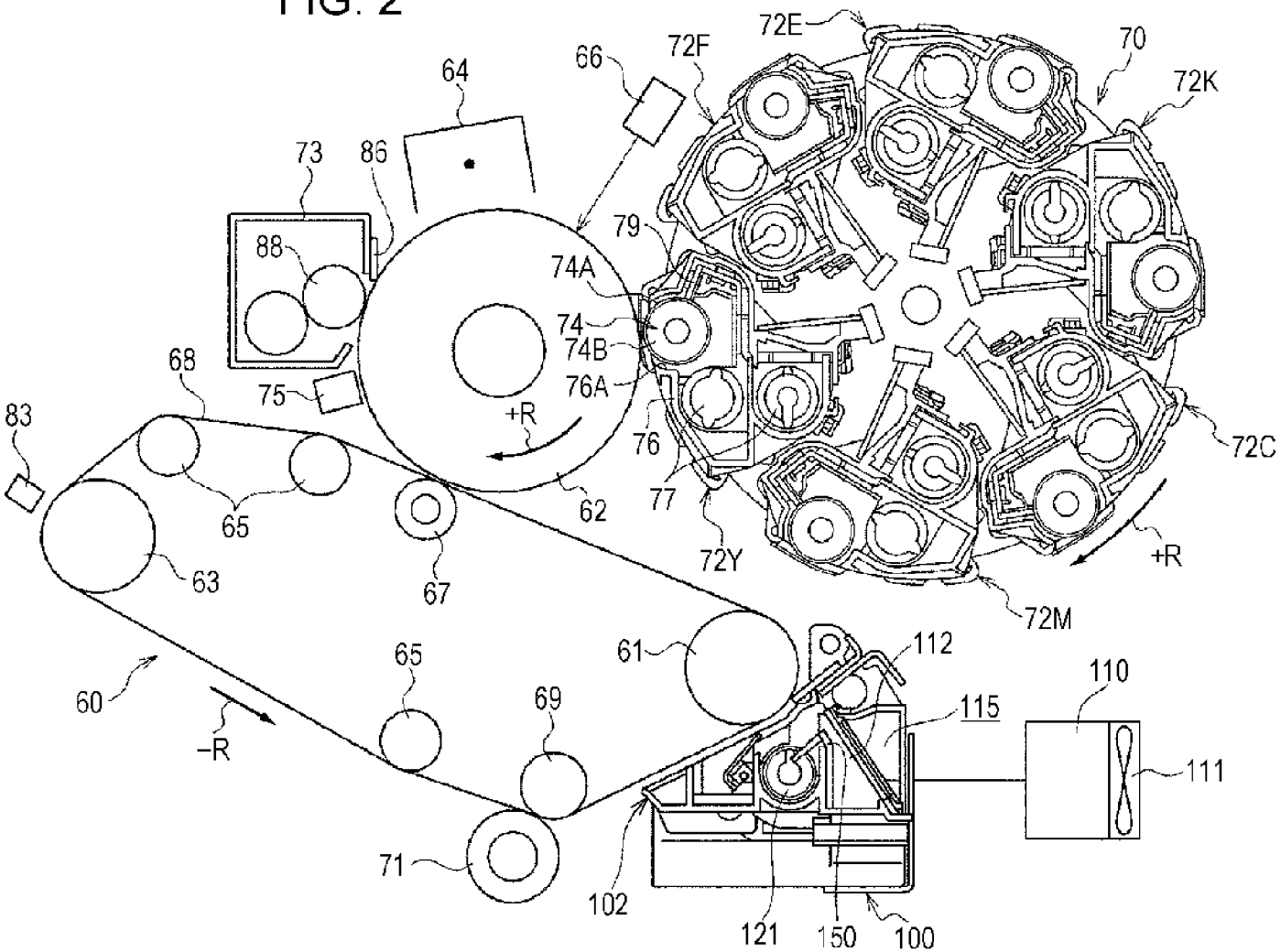
FIG. 2 illustrates the structure of an image forming unit according to the exemplary embodiment.

As illustrated in FIG. 2, the cleaning device 73 collects the residual toner and the like with a cleaning blade 86 and a brush roller 88 that are in contact with the outer peripheral surface of the photoconductor 62. An discharge device 75 is provided upstream of the cleaning device 73 and downstream of the first transfer roller 67 in the rotational direction of the photoconductor 62. The discharge device 75 removes the electric charge by irradiating the outer peripheral surface of the photoconductor 62 with light.

The discharge device 75 removes the electric charge by irradiating the outer peripheral surface of the photoconductor 62 with light before the residual toner and the like are collected by the cleaning device 73. Accordingly, the electrostatic adhesion force applied to the residual toner and the like on the outer peripheral surface of the photoconductor 62 is reduced and the collection rate of the residual toner and the like is increased. An additional discharge device for removing the electric charge on the outer peripheral surface of the photoconductor 62 after the collection of the residual toner and the like may be provided downstream of the cleaning device 73 and upstream of the charging member 64 in the rotational direction of the photoconductor 62.

As illustrated in FIG. 1, the second transfer position at which the toner images are transferred onto the sheet of recording paper P by the second transfer roller 71 is at an intermediate position of the transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71.

The fixing device 80 includes a heating roller 82 and a pressing roller 84. The heating roller 82 includes a heat source which generates heat when electricity is supplied thereto, and is disposed at the side of the sheet of recording paper P at which the toner images are formed (upper side). The pressing roller 84 is positioned below the heating roller 82, and presses the sheet of recording paper P against the outer peripheral surface of the heating roller 82. Transporting rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the horizontal direction in a replaceable manner in an area below the original-document reading device 56 and above the developing device 70.

The first and second specific colors E and F may be selected from specific colors (including transparent) other than yellow, magenta, cyan, and black. Alternatively, the first and second specific colors E and F are not selected. When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K.

In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

The developing device 70 will now be described.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which functions as a rotational drive source, in steps of 60°. Accordingly, one of the developing units 72Y, 72M, 72C, 72K, 72E, and 72F that is to perform a developing process is selectively opposed to the outer peripheral surface of the photoconductor 62.

The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown).

The casing member 76 has a rectangular opening 76A that is opposed to the outer peripheral surface of the photoconductor 62. A developing roller 74 is disposed in the opening 76A so as to face the outer peripheral surface of the photoconductor 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transporting augers 77 are rotatably arranged in parallel to each other in the casing member 76. The two transporting augers 77 rotate so as to circulate the developer contained in the casing member 76 in the axial direction of the developing roller 74 (longitudinal direction of the developing unit 72Y).

Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

The cleaning device 100 will now be described.

Referring to FIGS. 2 to 4B, the cleaning device 100 includes a housing 102, a cleaning blade 106, which is an example of a collecting member, and a sealing member 108. The housing 102 has a rectangular opening 104 that is opposed to the intermediate transfer belt 68. The cleaning blade 106 is provided at the upper side of the opening 104, and comes into contact with the intermediate transfer belt 68 to collect the residual toner T. The sealing member 108 is provided at the side opposite to the cleaning blade 106 (at the lower side of the opening 104), and comes into contact with the intermediate transfer belt 68 so as to seal a gap between the housing 102 and the intermediate transfer belt 68.

In the following description of each component in the housing 102, the longitudinal direction of the housing 102 and the opening 104 is defined as a Z-direction, the direction that is orthogonal to the Z-direction and extends along the plane including a bottom wall 102A of the housing 102 is defined as an X-direction, and the height direction of the housing 102 that is orthogonal to the X-direction and the Z-direction is defined as a Y-direction. The Z-direction extends in the front-back direction of the image forming apparatus 10 in front view (see FIG. 1).

Figure 3A:
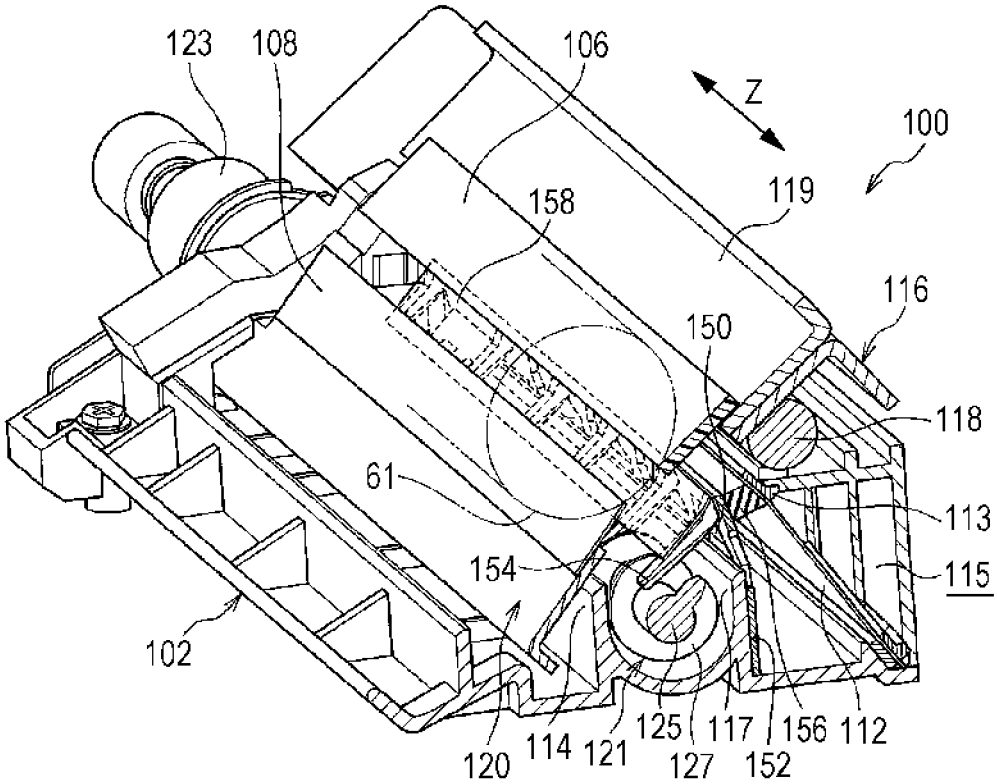
FIG. 3A is a perspective view illustrating the inner structure of a cleaning device when an intermediate transfer belt is in contact therewith.
Figure 3B:
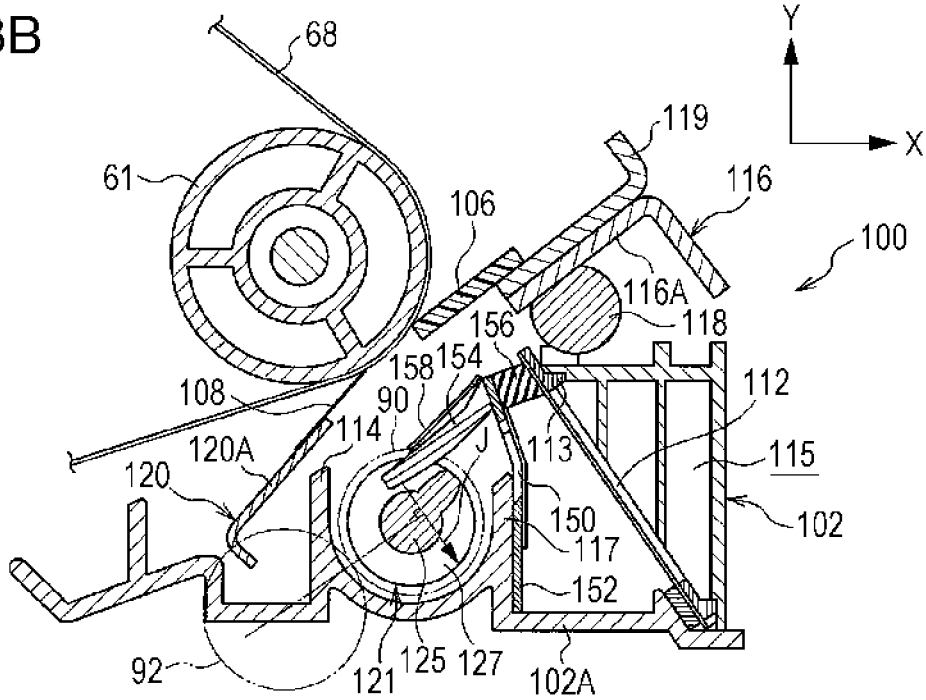
FIG. 3B is a sectional view illustrating the inner structure of the cleaning device when the intermediate transfer belt is in contact therewith.
Figure 4A:
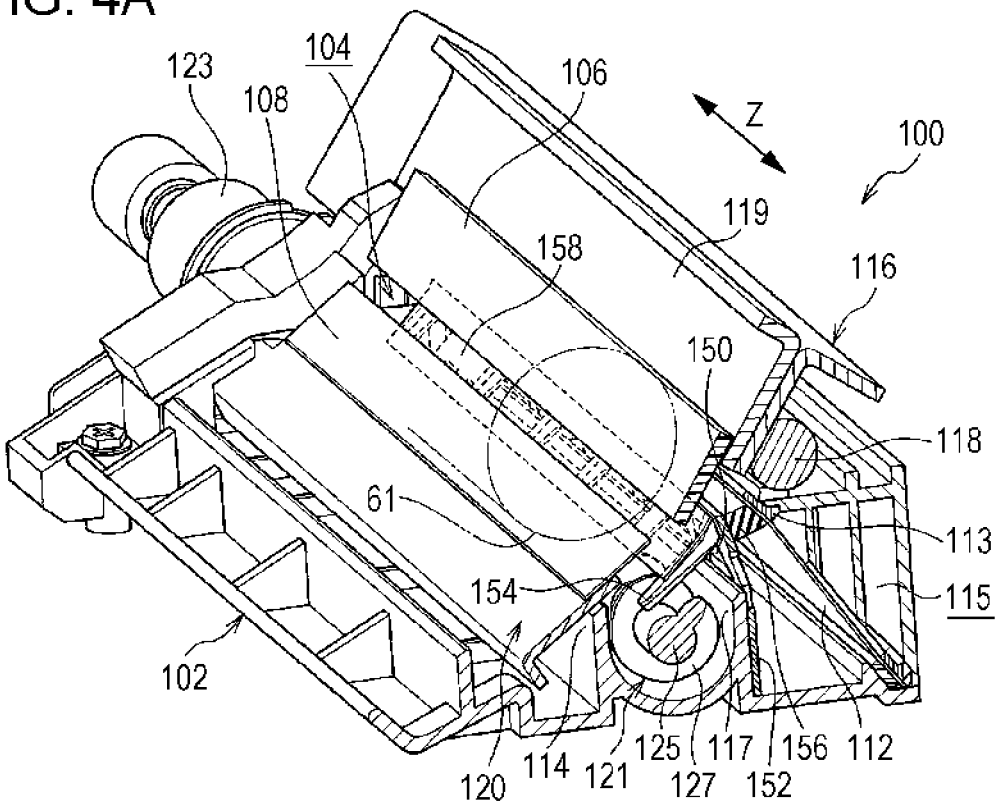
FIG. 4A is a perspective view illustrating the inner structure of the cleaning device when the intermediate transfer belt is separated therefrom.
Figure 4B:
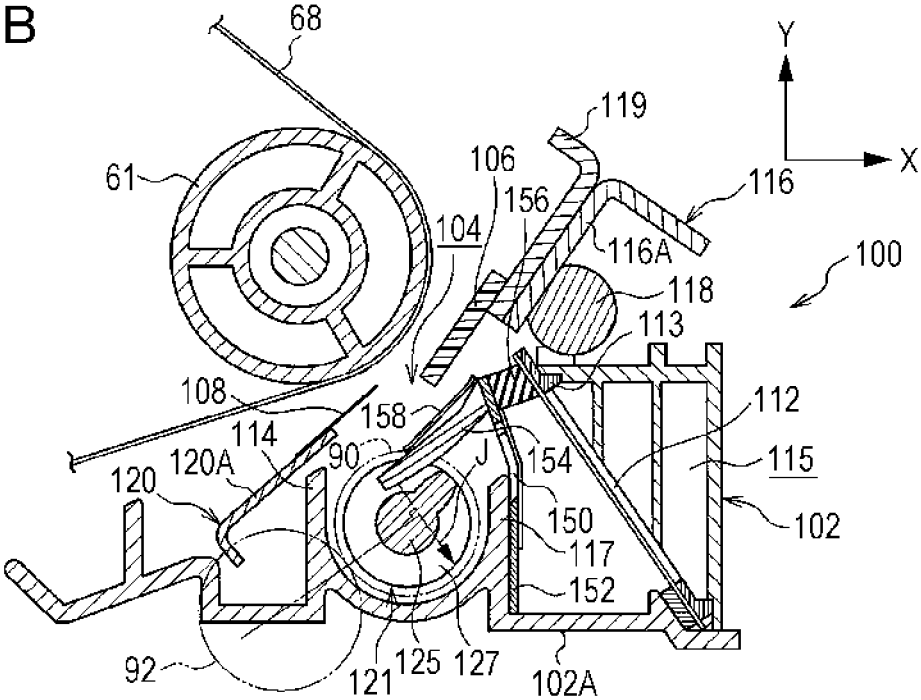
FIG. 4B is a sectional view illustrating the inner structure of the cleaning device when the intermediate transfer belt is separated therefrom.

As illustrated in detail in FIGS. 3A to 4B, a first movable member 116 made of a metal plate that is L-shaped in the X-Y plane is provided in the upper area of the housing 102 such that the longitudinal direction of the first movable member 116 extends in the Z-direction. FIGS. 3A and 3B illustrate the state in which the cleaning blade 106 and the sealing member 108 are in contact with the intermediate transfer belt 68, and FIGS. 4A and 4B illustrate the state in which the cleaning blade 106 and the sealing member 108 are separated from the intermediate transfer belt 68.

The first movable member 116 is arranged such that it is inverted-V-shaped in the X-Y plane, and includes an inclined portion 116A (portion that extends toward the lower left in FIGS. 3A to 4B). A supporting shaft 118 is fixed to the back surface (surface facing a suction path 115, which will be described below) of the inclined portion 116A such that the axial direction thereof extends in the Z-direction. The supporting shaft 118 is rotatably supported by bearings (not shown) at the ends thereof.

A supporting plate 119 made of a metal plate that is L-shaped in the X-Y plane is attached to the front surface of the inclined portion 116A of the first movable member 116. An end portion of the cleaning blade 106 in the short-side direction thereof (downstream end in the transporting direction) is fixed to the bottom end of the supporting plate 119 by adhesion. The cleaning blade 106 is arranged so as to extend along the inclination direction of the inclined portion 116A.

The cleaning blade 106 is a plate made of resin that has a rectangular shape in plan view, and is attached to the supporting plate 119 such that the longitudinal direction of the cleaning blade 106 extends along the longitudinal direction of the opening 104. Thus, the cleaning blade 106 is provided along the edge of the opening 104 at the downstream end thereof in the transporting direction of the intermediate transfer belt 68 (direction shown by arrow −R).

When the retracting mechanism (not shown) is set to a contact state, the cleaning blade 106 is arranged such that a free end thereof (end that is not fixed to the supporting plate 119) is in contact with the intermediate transfer belt 68. In this state, the cleaning blade 106 collects the residual toner T on the intermediate transfer belt 68 into the housing 102.

A second movable member 120 made of an L-shaped metal plate is provided in the lower area of the housing 102 in the X-Y plane such that the longitudinal direction of the second movable member 120 extends in the Z-direction. The second movable member 120 is arranged such that it is inverted-V-shaped in the X-Y plane, and includes an inclined portion 120A (portion that extends toward the lower left in FIGS. 3A to 4B) in an upper area thereof. A rotatable supporting shaft (not shown) is attached to the back surface of the inclined portion 120A such that the axial direction thereof extends in the Z-direction.

Thus, the second movable member 120 is rotatably supported. The second movable member 120 is rotated (moved) in association with the movement of the first movable member 116 by the above-described retracting mechanism. An end portion of the sealing member 108 in the short-side direction thereof (upstream end in the transporting direction) is fixed to the top end of the inclined portion 120A of the second movable member 120.

The sealing member 108 is, for example, a transparent film having a rectangular shape in plan view, and is attached to the second movable member 120 such that the sealing member 108 comes into contact with the intermediate transfer belt 68 along the edge of the opening 104 at the upstream end thereof in the transporting direction of the intermediate transfer belt 68.

When the retracting mechanism is set to the contact state and the cleaning blade 106 is in contact with the intermediate transfer belt 68, the sealing member 108 is arranged such that a free end thereof (end that is not attached to the second movable member 120) is in contact with the intermediate transfer belt 68. In this state, the sealing member 108 seals the gap between the housing 102 and the intermediate transfer belt 68.

The sealing member 108 is disposed below the cleaning blade 106, and the end portion of the sealing member 108 is pointed toward the downstream in the moving direction of the intermediate transfer belt 68. Therefore, the sealing member 108 does not remove the residual toner T from the intermediate transfer belt 68.

The first movable member 116, the supporting shaft 118, the supporting plate 119, and the second movable member 120 form a part of the housing 102. The opening 104 is an open area that is formed in the housing 102 and that extends from the bottom end of the supporting plate 119 to the top end of the second movable member 120.

The cleaning device 100 is connected to a suction unit 110 (see FIG. 2) that sucks the residual toner T and the like that remain on the intermediate transfer belt 68 into the housing 102. The suction unit 110 includes a suction fan unit 111. A first filter 112 for collecting dust including the residual toner T by using a flow of air (airflow) generated by the suction unit 110 is disposed in the housing 102.

The first filter 112 is a fiber assembly, and is formed in a rectangular shape that is long in the longitudinal direction of the housing 102 (Z-direction). The first filter 112 is bonded to an attachment member 113, which is attached to the housing 102. The attachment member 113 is a frame member obtained by forming plural openings of rectangular through holes in a rectangular plate along the longitudinal direction of the plate. The attachment member 113 is disposed below the supporting shaft 118 such that a lower portion of the attachment member 113 is farther away from the intermediate transfer belt 68 and the opening 104 than an upper portion thereof in the X-Y plane.

The attachment member 113 sections the housing 102 such that the suction path 115 having an inverted triangular shape in the X-Y plane is provided at the right side of the housing 102 in FIG. 3B. The suction path 115 extends in the longitudinal direction of the housing 102. A pair of partition walls 114 and 117 are provided on the bottom wall 102A so as to stand upright in an area between the opening 104 and the first filter 112 in side view (X-Y plane) of the housing 102.

A transporting auger 121 is disposed in the lower area of the housing 102 in the space between the pair of partition walls 114 and 117. The transporting auger 121 includes a rotating shaft 125 whose axial direction extends in the Z-direction and a helical blade 127 that is formed on the outer peripheral surface of the rotating shaft 125. The transporting auger 121 is rotated so as to transport the residual toner T collected in the housing 102 to one end thereof in the axial direction (longitudinal direction of the housing 102).

A transmission gear 90 is coaxially attached to the rotating shaft 125 of the transporting auger 121 in the Z-direction at the back end thereof in the Z-direction. The transmission gear 90 meshes with a driving gear 92 that is provided at the back side in the Z-direction. The transmission gear 90 and the driving gear 92 are shown by imaginary lines in FIGS. 3B and 4B. The controller 20 (see FIG. 1) controls a motor (not shown) that rotates the driving gear 92. Thus, the transporting auger 121 is rotated and the residual toner T collected in the housing 102 is transported toward the back side in the Z-direction.

A cylindrical collection path 123 is provided at the back end of the housing 102 in the Z-direction. The residual toner T transported by the transporting auger 121 is guided to a collection tank (not shown) through the collection path 123. The pair of partition walls 114 and 117 and the transporting auger 121 form an example of a developer transporting unit.

Referring to FIGS. 3A to 5, a second filter 150, which is an example of a filter member, for collecting dust including the residual toner T is provided between the first filter 112 (the suction path 115) and the transporting auger 121 (at a position upstream of the first filter 112 in the direction of the airflow in the suction operation). The second filter 150 is also a fiber assembly, and is formed in a rectangular shape that is long in the longitudinal direction of the housing 102 (Z-direction). The second filter 150 is attached to an attachment member 152 by adhesion.

The attachment member 152 is an example of a ladder-shaped frame member, and is obtained by forming plural openings 153 of substantially rectangular through holes in a rectangular plate along the longitudinal direction of the plate. The attachment member 152 includes a pair of horizontal frame elements 152A that are long in the longitudinal direction of the housing 102 and plural vertical frame elements 152B that connect the horizontal frame elements 152A. The second filter 150 is attached to the attachment member 152, so that the second filter 150 is exposed at the openings 153.

A lower portion of the attachment member 152 is attached to the outer surface (surface that faces the first filter 112) of the partition wall 117 near the first filter 112 by adhesion. At least an upper portion of the attachment member 152, more specifically, an upper portion of the attachment member 152 including upper halves of the openings 153 at which the second filter 150 is exposed, is inclined (tilted) so as to overlap the transporting auger 121 (the blade 127) and the partition wall 117 (developer transporting unit) in plan view.

Lug portions 154, which are examples of sliding portions, project from upper portions of the vertical frame elements 152B (portions of the horizontal frame element 152A on the extension lines from the vertical frame elements 152B) of the attachment member 152. The lug portions 154 extend toward the transporting auger 121. The lug portions 154 extend to positions where the lug portions 154 interfere with the blade 127 of the transporting auger 121. When the transporting auger 121 is rotated and the blade 127 is moved accordingly, the lug portions 154 are pushed upward by the blade 127.

When the lug portions 154 are pushed upward by the blade 127, the upper portion of the attachment member 152 is elastically deformed toward the first filter 112 such that the upper portion of the attachment member 152 stands upright. Then, when the lug portions 154 are released from the blade 127, the lug portions 154 suddenly return (fall) to the original state (see FIGS. 8A to 8C). Accordingly, the second filter 150 (the attachment member 152) is vibrated in the vertical direction, so that the residual toner T caught by the second filter 150 falls onto the transporting auger 121.

A regulating member 156 made of rubber or the like is provided between the upper portion of the second filter 150 (the attachment member 152) and the upper portion of the first filter 112 (the attachment member 113). The regulating member 156 regulates the elastic deformation of the attachment member 152 of the second filter 150. Accordingly, the positions of the lug portions 154 on the attachment member 152 with respect to the blade 127 of the transporting auger 121 are appropriately maintained.

Figure 5:
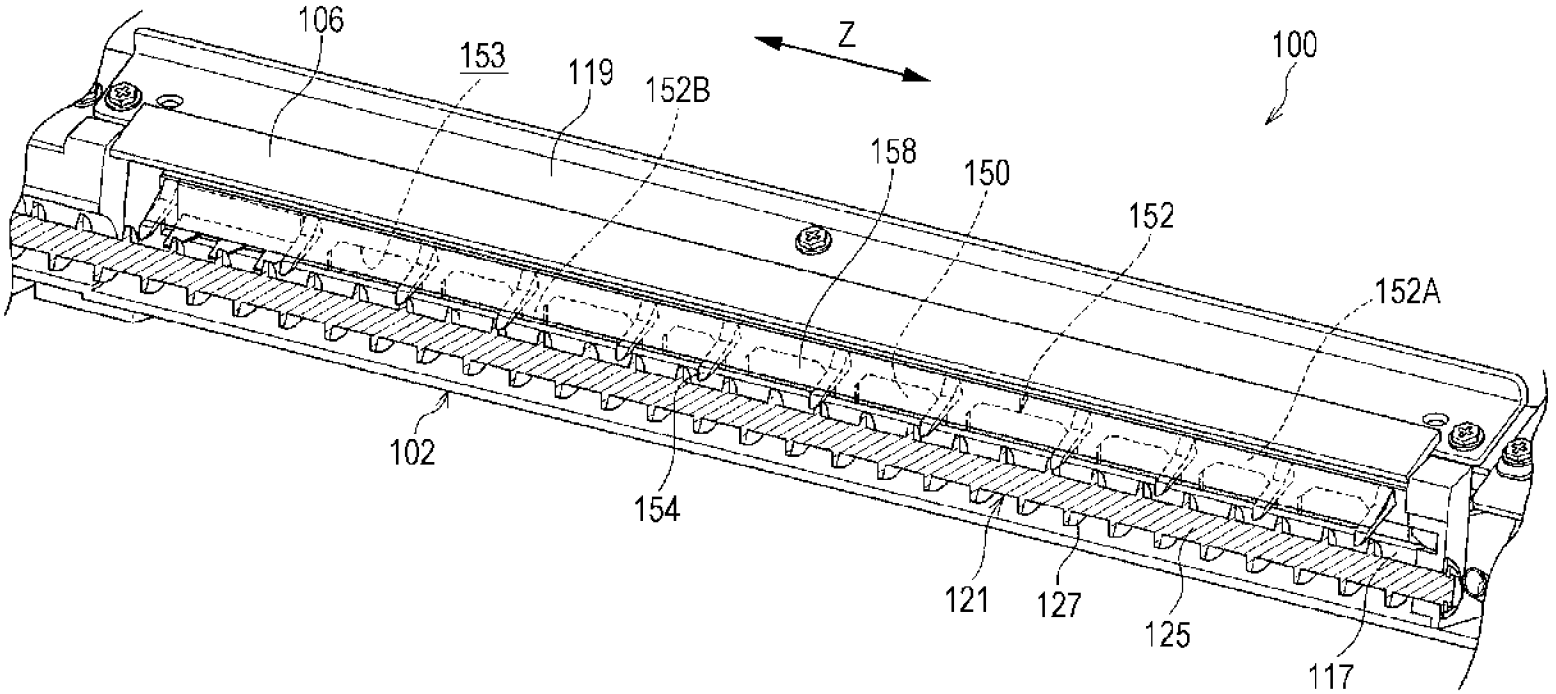
FIG. 5 is a perspective view illustrating a second filter and a hood member included in the cleaning device.
Figure 6:
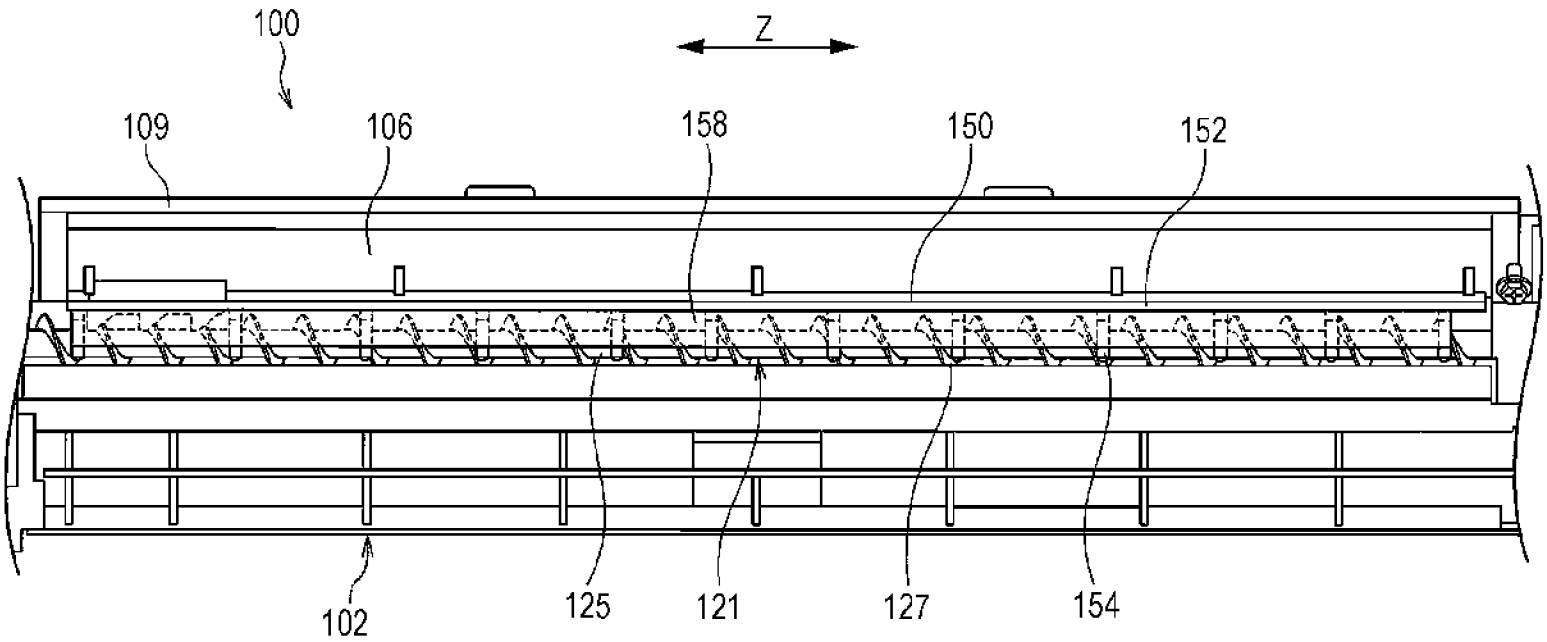
FIG. 6 is a plan view illustrating lug portions that project from the second filter and the hood member in the cleaning device.
Figure 7:
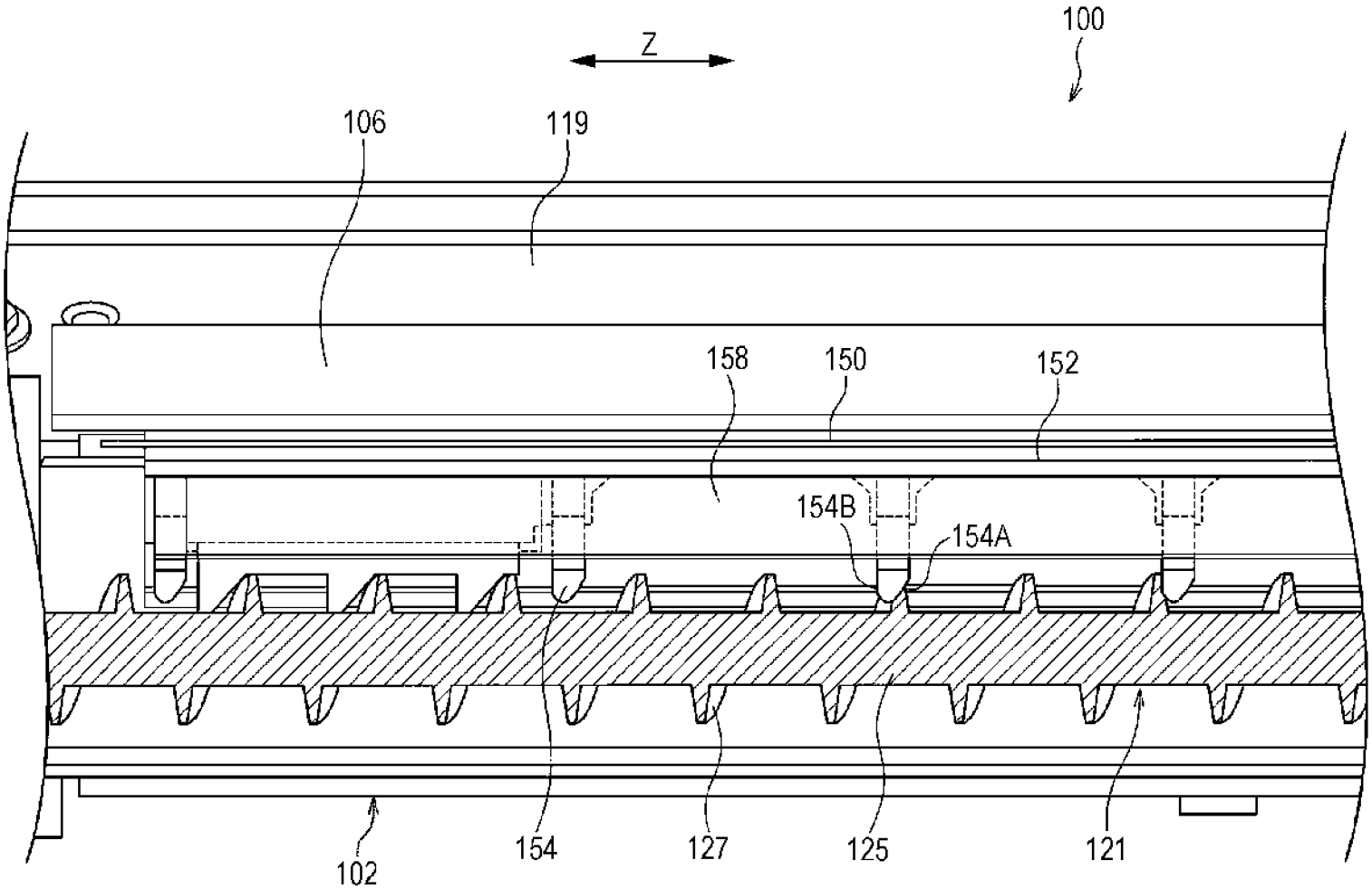
FIG. 7 illustrates the lug portions that project from the second filter, the hood member, and a transporting auger in the cleaning device.

As illustrated in FIG. 5, the openings 153 in the attachment member 152 have different sizes in the longitudinal direction. Accordingly, as illustrated in FIGS. 6 and 7, intervals between the lug portions 154 are not constant. When the transporting auger 121 is in a stationary state, some of the lug portions 154 are always shifted (displaced) from the blade 127.

Accordingly, each part of the second filter 150 (the attachment member 152) in the longitudinal direction (front-back direction) thereof vibrates in the vertical direction at different timings. In other words, the intervals between the lug portions 154 in the longitudinal direction are set such that the lug portions 154 are pushed upward at different timings.

Figure 8A:
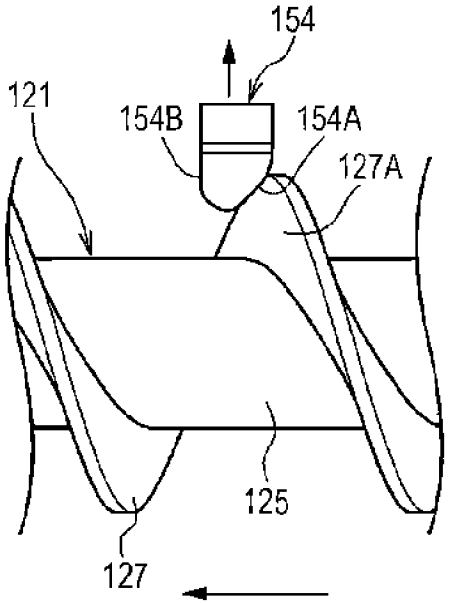
FIGS. 8A, 8B, and 8C illustrate the manner in which each lug portion is pushed upward by the blade of the transporting auger.
Figure 8B:
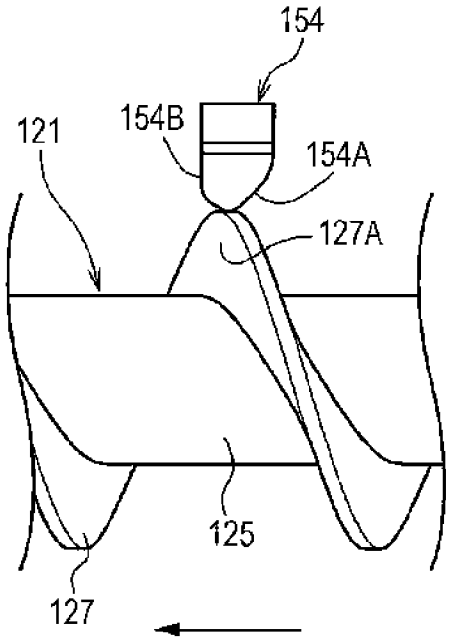
Figure 8C:
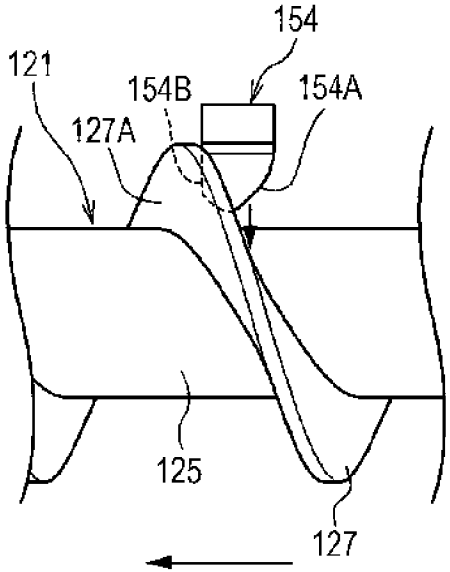

Referring to FIGS. 7 to 8C, each lug portion 154 has an inclined surface 154A at the upstream side thereof in a toner transporting direction, that is, at the side at which the blade 127 comes into contact with the lug portion 154 when the transporting auger 121 (the rotating shaft 125) is rotated in the normal direction to transport the residual toner T collected in the housing 102 to the collection tank. The inclined surface 154A extends substantially along a transporting surface 127A of the blade 127. For example, in FIGS. 8A to 8C, the inclined surface 154A is inclined by 45° with respect to the axial direction of the rotating shaft 125. In addition, each lug portion 154 has a vertical surface 154B that extends substantially vertically (that is inclined by about 90° with respect to the axial direction of the rotating shaft 125) at the downstream side in the toner transporting direction.

Accordingly, when the transporting auger 121 is rotated in the normal direction, the blade 127 smoothly comes into contact with the lug portions 154 without being caught by the lug portions 154, and pushes the lug portions 154 upward so as to elastically deform the attachment member 152. Then, when the lug portions 154 are released from the blade 127, the lug portions 154 suddenly returns (falls) to the original state (positions), so that a maximum level of vibration may be applied to the second filter 150 (the attachment member 152) from the lug portions 154.

As described above, when the transporting auger 121 is rotated, the lug portions 154 are pushed upward (the attachment member 152 is elastically deformed) by the blade 127. At this time, the transporting auger 121 receives a reaction force J (see FIGS. 3B and 4B) in a substantially downward direction (downward direction that is orthogonal to the direction in which the lug portions 154 extend in the X-Y plane).

The driving gear 92 that meshes with the transmission gear 90, which is coaxially provided on the rotating shaft 125 of the transporting auger 121, is arranged at the side of the transmission gear 90 at which the driving gear 92 does not become disengaged from the transmission gear 90 by the reaction force J. For example, the driving gear 92 is disposed at the side of the transmission gear 90 in the downward direction that is orthogonal to the direction in which the reaction force J is applied (at a position below the second movable member 120). Thus, the transmission gear 90 and the driving gear 92 are prevented from causing an engagement failure, and rotation failure of the rotating shaft 125 is prevented.

As illustrated in FIGS. 3A to 7, a rectangular hood member 158, which is long in the longitudinal direction of the housing 102, is provided along the longitudinal direction of the housing 102 on the lug portions 154, that is, at a position between the opening 104 and the second filter 150 and separated from the second filter 150. More specifically, the back surface of the hood member 158 is bonded to the top edge portion of the attachment member 152 and the top surfaces of the lug portions 154. Thus, the hood member 158 is attached to and supported by the lug portions 154 so as to extend over the lug portions 154.

For example, the hood member 158 has a thickness of about 0.8 mm, and is made of nonwoven fabric having a function of removing static electricity (eliminate member). The width (dimension in the direction orthogonal to the longitudinal direction) of the hood member 158 is set such that the hood member 158 does not come into contact with the transporting auger 121. Owing to the hood member 158, the airflow from the opening 104 to the second filter 150 in the housing 102 is regulated such that the air flows around the transporting auger 121. Accordingly, the collection rate of the residual toner T collected by the transporting auger 121 is increased and the amount of residual toner T that flows toward the second filter 150 is reduced.

The operation of the present exemplary embodiment will now be described. First, an image forming process performed by the image forming apparatus 10 will be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

As illustrated in FIGS. 4A and 4B, the cleaning blade 106 and the sealing member 108 in the cleaning device 100 are separated from the outer peripheral surface of the intermediate transfer belt 68 by the operation of the retracting mechanism until the toner images of the respective colors are transferred onto the intermediate transfer belt 68 in a superimposed manner (first transfer process) and then are transferred onto the sheet of recording paper P (second transfer process).

The exposure device 66 emits light in accordance with the image data, and the outer peripheral surface of the photoconductor 62, which has been charged by the charging member 64, is exposed to the emitted light. Accordingly, an electrostatic latent image corresponding to the yellow image data is formed on the outer peripheral surface of the photoconductor 62. The electrostatic latent image formed on the outer peripheral surface of the photoconductor 62 is developed as a yellow toner image by the developing unit 72Y. The yellow toner image on the outer peripheral surface of the photoconductor 62 is transferred onto the intermediate transfer belt 68 by the first transfer roller 67.

Then, referring to FIG. 1, the developing device 70 is rotated by 60° in the direction shown by arrow +R, so that the developing unit 72M is opposed to the outer peripheral surface of the photoconductor 62. Then, the charging process, the exposure process, and the developing process are performed so that a magenta toner image is formed on the outer peripheral surface of the photoconductor 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are additionally transferred onto the intermediate transfer belt 68 depending on the color setting.

A sheet of recording paper P is fed from the sheet storing section 12 and transported along the transport path 28. Then, the sheet is transported by the positioning rollers 38 to the second transfer position in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

After the second transfer process, as illustrated in FIGS. 3A and 3B, the cleaning blade 106 and the sealing member 108 in the cleaning device 100 are brought into contact with the outer peripheral surface of the intermediate transfer belt 68 by the operation of the retracting mechanism. Then, the residual toner T that remains on the outer peripheral surface of the intermediate transfer belt 68 is removed therefrom by the cleaning blade 106 and collected into the housing 102.

The sheet of recording paper P onto which the toner images have been transferred is transported toward the fixing device 80 in the direction shown by arrow A (rightward in FIG. 1). The fixing device 80 fixes the toner images on the sheet of recording paper P by applying heat and pressure thereto with the heating roller 82 and the pressing roller 84. The sheet of recording paper P on which the toner images are fixed are ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction shown by arrow −V. Then, the sheet of recording paper P is transported in the direction shown by arrow +V, so that the leading and trailing edges of the sheet of recording paper P are reversed. Then, the sheet of recording paper P is transported along the reverse transport path 29 in the direction shown by arrow B (leftward in FIG. 1), and is inserted into the transport path 28. Then, the back surface of the sheet of recording paper P is subjected to the image forming process, in which the cleaning blade 106 and the sealing member 108 are set to a retracted state, and the fixing process.

After the fixing process, the cleaning blade 106 and the sealing member 108 are brought into contact with the outer peripheral surface of the intermediate transfer belt 68 by the operation of the retracting mechanism. Accordingly, the residual toner T that remains on the outer peripheral surface of the intermediate transfer belt 68 is removed therefrom by the cleaning blade 106 and collected into the housing 102.

The operation of the cleaning device 100 will now be described.

Figure 9A:
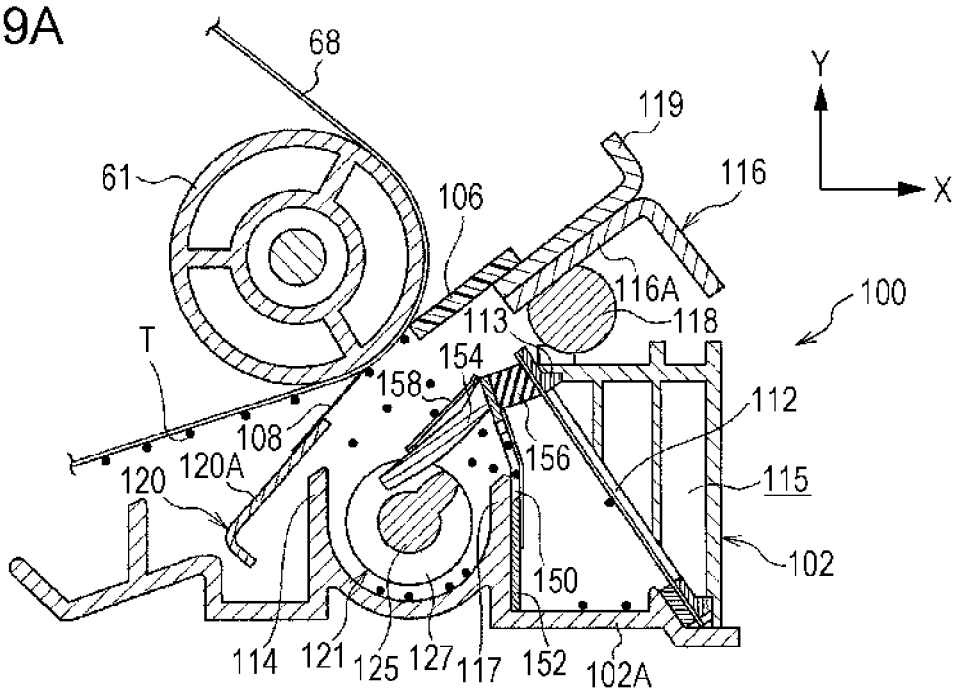
FIG. 9A is a sectional view illustrating the manner in which residual toner is collected when the intermediate transfer belt is in a contact state.

After the second transfer process in which the toner images are transferred onto the sheet of recording paper P, the residual toner T that has not been transferred remains on the outer peripheral surface of the intermediate transfer belt 68, as illustrated in FIG. 9A. The residual toner T is transferred to the cleaning device 100 by the rotation of the intermediate transfer belt 68 in the direction shown by arrow −R. Then, the residual toner T is collected into the housing 102 by the edge of the cleaning blade 106 that is in contact with the outer peripheral surface of the intermediate transfer belt 68.

At this time, the end portion of the sealing member 108 is in contact with the outer peripheral surface of the intermediate transfer belt 68 so as to seal the gap between the housing 102 and the sealing member 108. Accordingly, the residual toner T collected in the housing 102 is prevented form leaking to the outside of the housing 102. Since the end portion of the sealing member 108 is pointed toward the downstream in the moving direction of the intermediate transfer belt 68, the sealing member 108 does not remove the residual toner T from the intermediate transfer belt 68. At this time, the transporting auger 121 is rotated and the suction unit 110 (the fan unit 111) is activated.

Figure 9B:
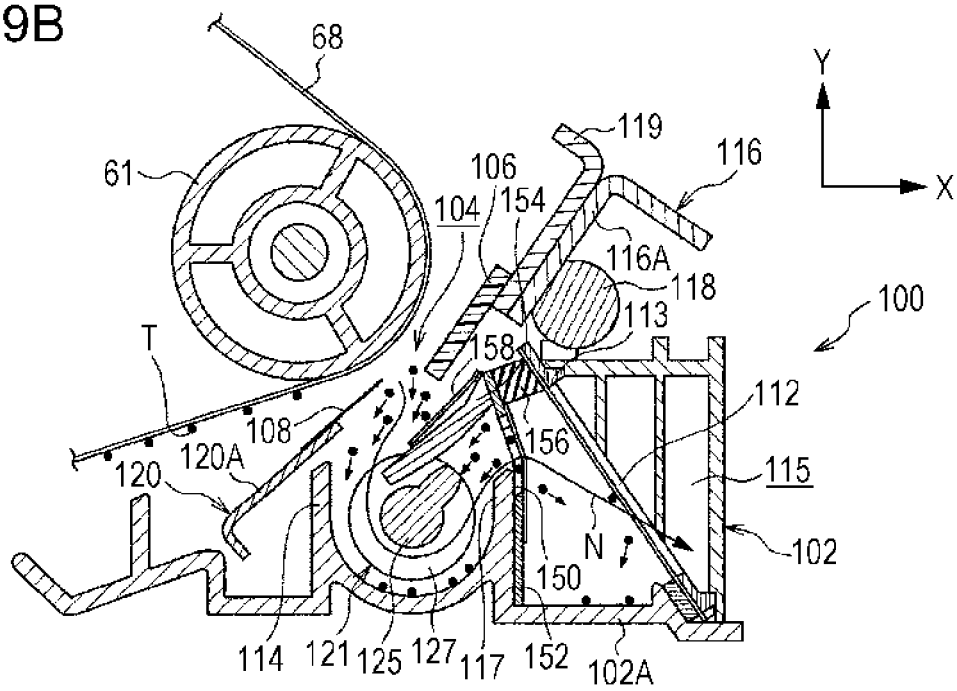
FIG. 9B is a sectional view illustrating the manner in which residual toner is collected when the intermediate transfer belt is in a non-contact state.

Then, when the next image forming process is started by the image forming apparatus 10, as illustrated in FIG. 9B, the cleaning blade 106 and the sealing member 108 are set to the retracted state in which the end portions thereof are separated from the outer peripheral surface of the intermediate transfer belt 68. At this time, the rotation of the transporting auger 121 is stopped. However, the suction unit 110 (the fan unit 111) is continuously activated.

Therefore, the pressure in the suction path 115 and the housing 102 is set to a negative pressure, and the air is caused to flow from the housing 102 to the suction path 115. Accordingly, the flow of air (airflow) from the opening 104 to the second filter 150 and the first filter 112 is generated in the direction shown by arrow N (see FIG. 9B). As a result, the residual toner T collected in the housing 102 is prevented from scattering and adhering to the outer peripheral surface of the intermediate transfer belt 68 again.

The residual toner T carried by the flow of air (airflow) is caught by the second filter 150, or is blocked by the second filter 150 or the attachment member 152 and falls. The residual toner T that passes through the second filter 150 is caught by the first filter 112, or is blocked by the first filter 112 or the attachment member 113 and falls.

The upper portion of the second filter 150 is inclined (tilted) so as to overlap the partition wall 117 and the transporting auger 121 in plan view. Therefore, part of the residual toner T that has been sucked in through the opening 104 is blocked by the second filter 150 or the attachment member 152 and falls onto the transporting auger 121, or is once caught by the second filter 150 and then falls. Thus, the amount of residual toner T caught by the second filter 150 is reduced and clogging of the second filter 150 is suppressed.

The first filter 112 is also inclined (tilted) in the housing 102. Therefore, compared to the case in which the first filter 112 stands vertically in the housing 102, the installation area is larger and the residual toner T caught by the first filter 112 more easily falls therefrom. The residual toner T that has passed through the second filter 150 is caught by the first filter 112 or falls onto the bottom wall 102A of the housing 102 in the area between the second filter 150 and the first filter 112.

Since part of the residual toner T is caught by the second filter 150, the amount of residual toner T that flows to the first filter 112 is reduced. As a result, clogging of the first filter 112 is also suppressed. As a result, reduction in the suction force applied to the residual toner T by the suction unit 110 is suppressed, and the cleaning device 100 may be used for a long time.

When the end portions of the cleaning blade 106 and the sealing member 108 are brought into contact with the outer peripheral surface of the intermediate transfer belt 68 again, as illustrated in FIG. 9A, the rotation of the transporting auger 121 is started. Accordingly, the residual toner T collected in the housing 102 is transported by the transporting auger 121.

At this time, as illustrated in FIGS. 8A and 8B, each lug portion 154 is pushed upward by the blade 127 as the transporting auger 121 is rotated. Accordingly, the attachment member 152 is elastically deformed such that the attachment member 152 stands upright. Then, as illustrated in FIG. 8C, when the lug portion 154 is released from the blade 127, the attachment member 152 (the lug portion 154) suddenly returns (falls) to the original state. Thus, the second filter 150 (the attachment member 152) is vibrated in the vertical direction.

Owing to the vibration of the second filter 150, the residual toner T caught by the second filter 150 falls onto the transporting auger 121, and clogging of the second filter 150 is further suppressed. Moreover, the lug portions 154 are arranged such that when some of the lug portions 154 are interfering with the blade 127 of the transporting auger 121, the other lug portions 154 do not interfere with the blade 127 of the transporting auger 121. Thus, front and back parts of the second filter 150 (the attachment member 152) in the longitudinal direction thereof vibrate at different timings. For example, the second filter 150 (the attachment member 152) vibrates with time differences from the front end thereof to the back end thereof.

Thus, the second filter 150 (the attachment member 152) may be efficiently vibrated. In addition, compared to the case in which the second filter 150 (the attachment member 152) is simultaneously vibrated over the entire area (including the first and back ends) thereof in the longitudinal direction, abnormal noise caused by the vibration may be reduced. In addition, in the image formed by the image forming process, banding (white lines) caused by the vibration may be suppressed.

The side surface of each lug portion 154 at the upstream end thereof in the toner transporting direction, that is, the side surface to which the blade 127 comes into contact when the transporting auger 121 is rotated in the normal direction, is formed as the inclined surface 154A that extends substantially along the transporting surface 127A of the blade 127. Therefore, the blade 127 of the transporting auger 121 smoothly comes into contact with the lug portions 154 without being caught by the lug portions 154, and pushes the lug portions 154 upward.

Moreover, the lug portions 154 are provided so as to project from the upper portions of the vertical frame elements 152B of the attachment member 152 (on the extension lines from the vertical frame elements 152B). Therefore, when the lug portions 154 are pushed upward by the blade 127, bending (elastic deformation) of the attachment member 152 is suppressed or prevented. In other words, the rigidity of the attachment member 152 is ensured when the lug portions 154 are pushed upward by the blade 127. Therefore, compared to the structure in which the lug portions 154 are not provided so as to project from the upper portions of the vertical frame elements 152B of the attachment member 152, the second filter 150 (the attachment member 152) may be more largely vibrated.

In addition, the side surface of each lug portion 154 at the downstream end thereof in the toner transporting direction, that is, the side surface from which the blade 127 becomes separated when the transporting auger 121 is rotated in the normal direction, is formed as the vertical surface 154B. Therefore, when the lug portions 154 are released from the blade 127, the attachment member 152 (the lug portions 154) suddenly returns (falls) to the original state. Therefore, a maximum level of vibration may be applied to the second filter 150 (the attachment member 152).

The hood member 158 is provided along the longitudinal direction of the housing 102 on the lug portions 154, that is, at a position between the opening 104 and the second filter 150 and separated from the second filter 150. Therefore, as shown by arrow N in FIG. 9B, the air sucked in through the opening 104 flows around the transporting auger 121 toward the second filter 150.

Accordingly, the amount of residual toner T collected by the transporting auger 121 (collection rate) is increased and the amount of residual toner T that flows toward the second filter 150 (collection rate) is reduced. Therefore, clogging of the second filter 150 with the residual toner T is further suppressed and the life of the second filter 150 is increased.

In addition, since the hood member 158 serves as an eliminate member that has a function of removing static electricity, the residual toner T that has been collected through the opening 104 does not easily return (adhere) to the intermediate transfer belt 68 again by static electricity. The residual toner T that adheres to the hood member 158 falls from the hood member 158 onto the transporting auger 121 (is removed from the hood member 158) as a result of the above-described vibration of the second filter 150 (the attachment member 152). Then, the residual toner T is transported by the transporting auger 121.

In addition, the driving gear 92, which meshes with the transmission gear 90 that is coaxially provided on the rotating shaft 125 of the transporting auger 121, is arranged at the side of the transmission gear 90 in the downward direction that is orthogonal to the direction in which the reaction force J is applied by the lug portions 154 when the lug portions 154 are pushed upward by the blade 127 of the transporting auger 121.

If, for example, the driving gear 92 is provided on the transmission gear 90 at the upper side thereof, there is a risk that the transmission gear 90 will become disengaged from the driving gear 92 since the transporting auger 121 (the rotating shaft 125) is pushed downward by the lug portions 154. If the meshing depth between the transmission gear 90 and the driving gear 92 is increased to prevent them from becoming disengaged, the torque required for the rotation will be increased.

However, in the present exemplary embodiment, the driving gear 92 is arranged at the above-described position, so that the meshing depth between the driving gear 92 and the transmission gear 90 is not affected. In other words, the transmission gear 90 and the driving gear 92 do not become disengaged from each other, and the torque required for the rotation is not increased.

Although the cleaning device 100 according to the present exemplary embodiment is described above with reference to the drawings, a cleaning device according to an exemplary embodiment of the present invention is not limited to the cleaning device 100 illustrated in the drawings, and various design changes may be made within the scope of the present invention.

For example, the housing 102 is not necessarily fixed to the image forming apparatus 10. The housing 102 may instead be structured such that the entire body thereof is movable toward and away from the intermediate transfer belt 68 such that the cleaning blade 106 and the sealing member 108 are brought into contact with and separated from the outer peripheral surface of the intermediate transfer belt 68.

In addition, the hood member 158 is not limited to those made of nonwoven fabric, such as Denkitol (registered trademark), that has a function of removing static electricity. The hood member 158 may be composed of, for example, a film-shaped member made of resin as long as the hood member 158 has a function of removing static electricity.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer collecting device, comprising:

a housing provided with an opening opposed to a developer carrying member that carries and transports developer;

a collecting member provided along an edge of the opening at a downstream end of the opening in a transporting direction in which the developer carrying member transports the developer;

a sealing member provided along an edge of the opening at an upstream end of the opening in the transporting direction;

a suction path that extends along a longitudinal direction of the housing, the suction path being connected to a suction unit for sucking the developer removed from the developer carrying member into the housing;

a developer transporting unit provided between the opening and the suction path, the developer transporting unit transporting the developer collected in the housing;

a filter member disposed between the developer transporting unit and the suction path; and a hood member disposed between the opening and the filter member and separated from the filter member, wherein the developer transporting unit includes a rotating shaft and a helical blade attached to the rotating shaft and a sliding portion that slides along the blade that rotates is provided at an upper portion of the filter member, and wherein the filter member vibrates when the sliding portion is pushed upward and dropped by the blade that rotates.

2. The developer collecting device according to claim 1, wherein the hood member has a function of removing static electricity.

3. The developer collecting device according to claim 1, wherein the hood member is separated from the helical blade.

4. The developer collecting device according to claim 1, wherein the developer carrying member is an intermediate transfer member.

5. The developer collecting device according to claim 1, wherein the developer is toner.

6. The developer collecting device according to claim 1, wherein the hood member is supported by the sliding portion.

7. The developer collecting device according to claim 1, wherein a surface of the sliding portion to which the blade comes into contact is inclined along a transporting surface of the blade.

8. The developer collecting device according to claim 1, wherein the filter member is provided on a ladder-shaped frame including a pair of horizontal frame elements that extend along the longitudinal direction of the housing and a plurality of vertical frame elements arranged to connect the horizontal frame elements to each other, and wherein the sliding portion is provided at upper portions of the vertical frame elements.

9. The developer collecting device according to claim 1, wherein a plurality of the sliding portions are provided along a longitudinal direction of the filter member, and intervals between the sliding portions are set such that the sliding portions are pushed upward at different timings.

10. An image forming apparatus, comprising:

a latent-image carrying member that carries a latent image;

a developing unit that develops the latent image on the latent-image carrying member with developer to form a developer image;

a developer carrying member onto which the developer image on the latent-image carrying member is transferred and which carries the developer image;

a transfer unit that transfers the developer image on the developer carrying member onto a recording medium; and the developer collecting device according to claim 1, the developer collecting device coming into contact with the developer carrying member after the developer image is transferred onto the recording medium by the transfer unit and collecting the developer on the developer carrying member.

* * * * *